US008319161B2

(12) United States Patent
Zach et al.

(10) Patent No.: US 8,319,161 B2
(45) Date of Patent: Nov. 27, 2012

(54) METHOD AND DEVICE FOR UNIFORMLY HEATING A SAMPLE BY MICROWAVE RADIATION

(75) Inventors: Johannes Zach, St. Marein (AT); Rainer Zentner, Graz (AT); Anton Ziegler, Kainbach (AT); Heimo Kotzian, Graz (AT)

(73) Assignee: Anton Paar GmbH, Graz (AT)

( * ) Notice: Subject to any disclaimer, the term of this patent is extended or adjusted under 35 U.S.C. 154(b) by 435 days.

(21) Appl. No.: 12/765,359

(22) Filed: Apr. 22, 2010

(65) Prior Publication Data

US 2010/0270290 A1 Oct. 28, 2010

(30) Foreign Application Priority Data

Apr. 24, 2009 (EP) ..... 09158776

(51) Int. Cl.
*H05B 6/66* (2006.01)

(52) U.S. Cl. ..... 219/679

(58) Field of Classification Search ..... 219/679
See application file for complete search history.

(56) References Cited

U.S. PATENT DOCUMENTS

| | | | | |
|---|---|---|---|---|
| 4,681,470 | A | 7/1987 | Nakajima | 400/323 |
| 6,076,957 | A | 6/2000 | Gomes | 366/274 |
| 7,041,947 | B2 * | 5/2006 | Collins et al. | 219/679 |
| 2004/0050836 | A1 * | 3/2004 | Nesbitt et al. | 219/201 |
| 2006/0289502 | A1 * | 12/2006 | Sedlmayr | 219/688 |

FOREIGN PATENT DOCUMENTS

| | | |
|---|---|---|
| EP | 2 086 285 | 8/2009 |
| WO | WO 2005/099891 | 10/2005 |

* cited by examiner

*Primary Examiner* — Trung Q Dang
(74) *Attorney, Agent, or Firm* — Kusner & Jaffe

(57) ABSTRACT

The present invention concerns a method and a device for uniformly heating a sample by microwave radiation. According to the invention, at least one stirring element is immersed at least partly in a sample to be heated, said stirring element comprising a magnetic or magnetisable material. A rotating or oscillating magnetic field interacting with said stirring element is generated in a cavity adapted to receive the sample to be heated in order to impart a rotational or translational movement to said stirring element. The rotational or translational movement of said stirring element is contactlessly detected while applying microwave radiation to said sample.

15 Claims, 3 Drawing Sheets

METHOD AND DEVICE FOR UNIFORMLY HEATING A SAMPLE BY MICROWAVE RADIATION

FIELD OF THE INVENTION

The present invention concerns a method and device for uniformly heating a sample by microwave radiation.

BACKGROUND OF THE INVENTION

In microwave-assisted chemistry, microwaves are used to initiate, drive, or otherwise enhance chemical or physical reactions. Generally, the term "microwaves" refers to electromagnetic radiation having a frequency within a range of about $10^8$ Hz to $10^{12}$ Hz. These frequencies correspond to wavelengths between about 300 cm to 0.3 mm Microwave-assisted chemistry is currently employed in a variety of chemical processes. Typical applications in the field of analytical chemistry include ashing, digestion and extraction methods. In the field of chemical synthesis, microwave radiation is typically employed for heating reaction materials, many chemical reactions proceeding advantageously at higher temperatures. In addition, when pressureriseable reaction vessels are used, many analytical or synthetical processes can be further enhanced by increasing the pressure in the vessel. Further, when, for example, digestion methods for analytical purposes are used, the generation or expansion of gases inside the vessel will necessarily increase the internal pressure. Thus, in order to ensure that no reaction products are lost for subsequent analysis, vessels must be used which are able to withstand high internal pressures in these cases.

Usually, most microwave-assisted reactions are performed in open or, preferably, in sealed vessels at temperatures rising up to 300° C. Typical pressures range from below atmospheric pressure, e.g. in solvent extraction processes, up to 100 bar, e.g. in digestion or synthesis processes.

Microwave-assisted chemistry is essentially based on the dielectric heating of substances capable of absorbing microwave radiation, which is subsequently converted into heat.

Many apparatuses and methods currently employed in microwave-assisted chemistry are based upon conventional domestic microwave ovens operating at a frequency of 2.45 GHz. As magnetrons operating at this frequency are produced in large quantities for domestic appliances, microwave apparatuses for microwave-assisted chemistry using such magnetrons can be manufactured at relatively low cost.

In many applications, such as analytical chemistry and chemical synthesis, uniform heating of the samples is of utmost importance since, for example, reaction rates strongly depend on the temperature of the sample.

When heating samples by microwave radiation, pressurized sample vessels are often employed to increase the speed of the reaction and/or to increase the yield of the reaction. In order to fully benefit from the use of pressurized vessels or containers, it is important to ensure uniform reaction conditions throughout the sample. In prior art, it has therefore been suggested to control pressure and/or temperature in the sample vessel. It is also known to employ motorized stirrers or magnetically driven stirring elements to ensure uniform heating of the samples. For instance, in microwave heating, multimode-cavities are often employed which suffer from the drawback that standing waves within the cavity result in a pattern of hot and cold spots. Consequently, uniform stirring is important to avoid local overheating in hotspot areas and reduced reaction rates in cold spot areas, respectively. In cases where solid particulate substances are employed as reactants or catalysts, effective stirring can prevent sedimentation and ensure homogenous and uniform reaction conditions throughout the sample.

It is known that conditions in the sample vessel can drastically vary in the course of microwave-assisted chemical processes. For instance, an increase in sample viscosity or sedimentation during the process may result in a complete interruption of the stirring process. Especially, if magnetically driven stirring elements are employed, the stirring element immersed in the sample may stop rotating, while the magnetic actuator continues rotating. Controlling the rotation of the actuator only, may therefore lead to the false impression that stirring of the sample is still in progress. Thus, in conventional chemistry, visual inspection of the sample vessel is employed to ensure rotation of the stirring element.

In U.S. Pat. No. 6,076,957 a magnetic stirrer adapted for use with microwave ovens is described, where the sample to be heated is arranged on a turntable provided within a multimode cavity of a microwave oven. The stirring device includes a gear train assembly that increases in the normal rate of revolution of the microwave turntable by several fold and drives a magnetic actuator, which causes rotation of a magnetic stirring element immersed within the sample. In such devices, rotation of the stirring element can usually not be controlled by visual inspection. In addition, even in processes where starting viscosities and end viscosities should not pose particular problems, localized scaling or agglomerations may still stop the stirring element. Moreover, when a constantly rotating magnetic actuator is used, the stopped stirring element will usually not start-up rotating again, unless the actuator is also stopped or at least rotated with reduced speed and slowly brought up to the default rotational speed again.

Other techniques such as overhead stirrers using a drive shaft to rotate a stirring element connected to the drive shaft for aggressive chemical substances or pressure tight vessels and containers can scarcely be employed in microwave chemistry due to leakage problems, arching, surface currents etc.

SUMMARY OF THE INVENTION

It is therefore an object of the present invention to provide an improved method and device for uniformly heating a sample by microwave radiation, where reliable stirring of the sample to be heated is ensured even if opaque housings, sample containers/vessels and or opaque samples are employed.

According to the invention, this technical problem is solved by providing a method for uniformly heating a sample by microwave radiation, wherein the method comprises the steps of immersing at least one stirring element at least partly in a sample to be heated, said stirring element comprising a magnetic or a magnetisable material, generating a rotating or oscillating magnetic field interacting with said stirring element in order to impart a rotational or a translational movement to said stirring element, contactlessly detecting rotational or translational movement of said stirring element while applying microwave radiation to said sample. Thus, according to the invention, movement of the stirring element will be monitored, preferably continuously, during the microwave heating process. With the method of the present invention, neither optical inspection nor the use of directly driven stirring elements via motorized drive shafts are required to ensure reliable stirring of the sample. Consequently, the method of the invention is particularly suited to heating samples in pressurized vessels within a closed microwave cavity.

The rotating or oscillating magnetic field acting on the stirring element within the sample can for instance be generated by a moving external magnetic actuator driven by a suitable motor or by an external stationary solenoid system. In this respect, the term "external" refers to the location of the rotating magnetic actuator or the solenoid system outside of the sample. In one embodiment of the invention, the moving magnetic actuator can comprise permanent magnets which are rotated by a motor. In a particularly preferred embodiment, the stationary solenoid system comprises at least two electric coils capable of generating an alternating magnetic field. The coil system allows for an electronic control of the stirring process and can be adapted to rather small dimensions, thus being particularly suited to heat small sample vessels for instance in mono-mode microwave cavities.

Contactless detection of the movement of the stirring element refers to a detection technique which does not require physical contact between the detection device and the stirring element. Thus, any remotely detectible physical effect caused by a magnetic or magnetisable material moving within a magnetic field, can be used to detect the movement of the stirring element. Preferably, the translational or rotational movement of the stirring element is detected by measuring magnetic and/or electric effects caused by the magnetic or magnetised material of the stirring element. For instance, the moving magnetic or magnetised stirring element will itself cause a changing magnetic field, which is directly related to the movement of the stirring element. A rotational movement or an oscillating translational movement of the stirring element will result in a magnetic field changing with a certain frequency. For instance, sensors which are responsive to changes in the refractive index of a material caused to an electromagnetic field, such as Kerr cells may be employed. Preferably, however, sensors which produce varying output voltages in response to changes in an electromagnetic field, such as Hall sensors, are employed.

The driving electromagnetic field generated by the magnetic actuator or the solenoid system will, however, also generate a changing electromagnetic filed, which will usually be much larger than the filed changes induced by the moving stirring element. Thus, means have to be employed which allow detection of small signal variations in the presence of larger signal variations. In a preferred embodiment of the invention, phase-sensitive detection of the changing magnetic field caused by the stirring element is employed using for instance a lock-in amplifier in order to reliably discriminate between the driving electromagnetic field and the smaller electric magnetic field caused by the moving stirring element.

Another magnetic or electric effect caused by a moving stirring element, which can be used to detect movement of the stirring element, is a back electromotive force (bemf) caused by the moving magnetic or magnetised stirring element in the electric circuit of the driving solenoid system. For instance, if a current controlled solenoid system is used, the back electromotive force will vanish as soon as the stirring element stops and a subsequent decrease of the output voltage in the driving system can be detected. In a preferred embodiment, a pulse-width modulated output voltage signal is measured via a one-pole low pass filter. By comparing the measured output voltage with a calibrated voltage-frequency characteristic, one can readily determine whether the stirring element is still rotating.

In a preferred embodiment of the invention, the detected movement of the stirring element is used to control the operation of magnetic means for driving the stirring element (e.g. the moving magnetic actuator or the solenoid system) and/or to control the heating of the sample. Accordingly, if the measurement of the moving stirring element indicates that the stirring element has slowed down or even stopped, the control means can be adapted to change the driving parameters for the stirring element. For instance, the default rotational speed, the torque acting on the stirring element and/or the start-up characteristics for a re-start of the stopped stirring element can be adapted in order to maintain the stirring process. Thus, it is e.g. possible to slow down the driving magnetic actuator or reduce the frequency of the driving field produced by a stationary solenoid system for a transitional period and to increase the frequency again in order facilitate coupling of the stirring element to the driving field, which might help to start-up the stirring element again under certain conditions. Alternatively or in addition, the microwave heating power can be reduced or shut off. Once a restart of the stirring element is detected, the microwave heating power can be increased again to the intended level. In cases where local overheating is not critical, e.g. when larger samples are heated, it is possible to merely re-start the stirring element without reducing or shutting down the microwave output power.

The present invention is also concerned with a device for uniformly heating a sample by microwave radiation, comprising a cavity adapted to receive a sample to be heated, a source of microwave radiation adapted to generate a microwave field in said cavity, at least one stirring element adapted to be at least partly immersed in said sample, said stirring element comprising a magnetic or magnetisable material, means for generating a rotating or oscillating magnetic field interacting with the stirring element in order to impart a rotational or translational movement to the stirring element, and means for detecting rotational or translational movement of said stirring element.

The means for generating a rotating or oscillating magnetic field preferably comprise a movable magnetic actuator or a stationary solenoid system.

According to a preferred embodiment of the device of the invention, the means for detecting rotational or translational movement of said stirring element comprise means for measuring changing magnetic fields caused by said moving stirring element. In one embodiment, the means for measuring said changing magnetic fields may comprise for instance a Hall detector or a magneto-optic Kerr cell. In another embodiment, the means for measuring said changing magnetic fields may comprise suitable electronic means for measuring a back electromotive force (bemf) induced for instance in a coil. According to one embodiment, the coil may be part of the means for generating a rotating or oscillating magnetic field or the coil may be a separate detection coil.

In a preferred embodiment, the device of the present invention further comprises means for evaluating the speed of the stirring element, wherein said evaluation means are adapted to control at least one of said source of microwave radiation and said means for generating a rotating or oscillating magnetic field.

The invention will now be described in more detail making reference to preferred embodiments depicted in the attached drawings.

DETAILED DESCRIPTION OF THE INVENTION

Figure 1:
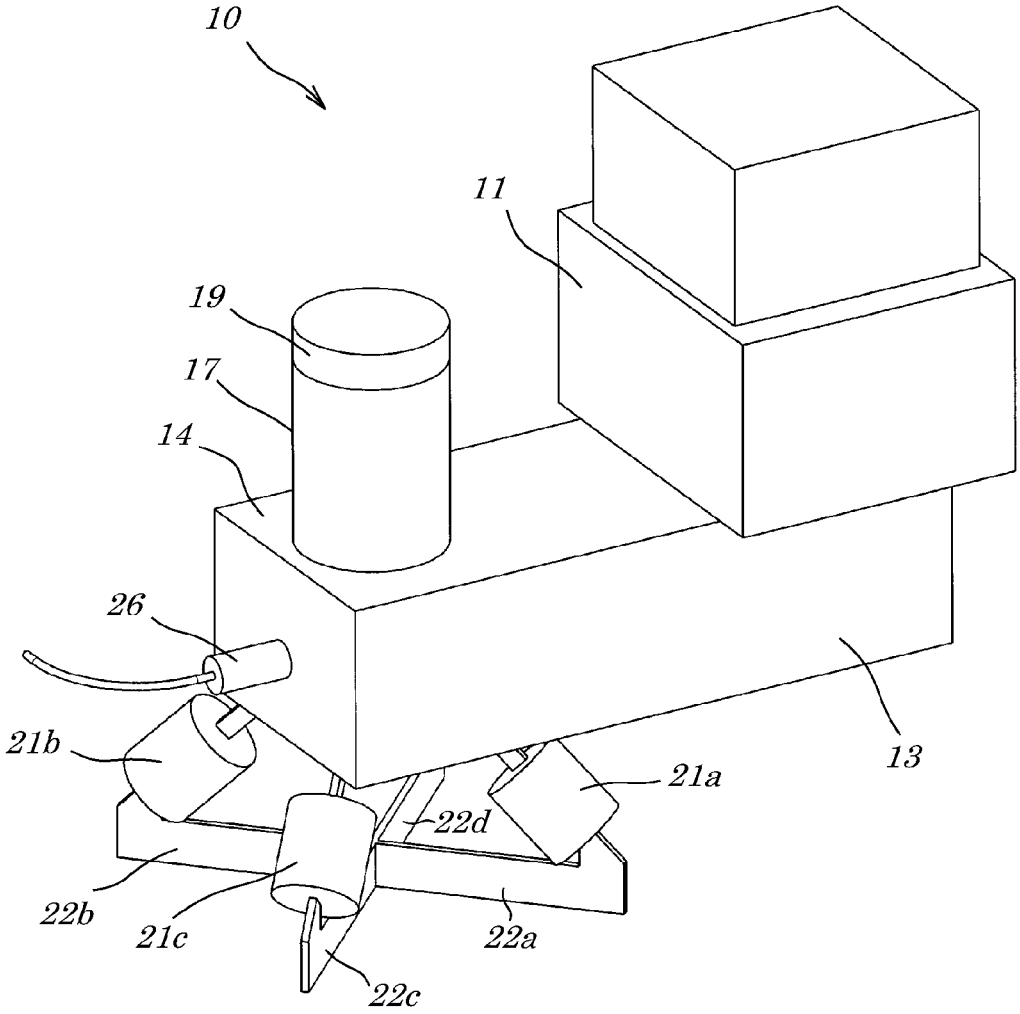
FIG. 1 is a schematic perspective view of a mono-mode microwave applicator equipped with a stirring system of the invention.
Figure 2:
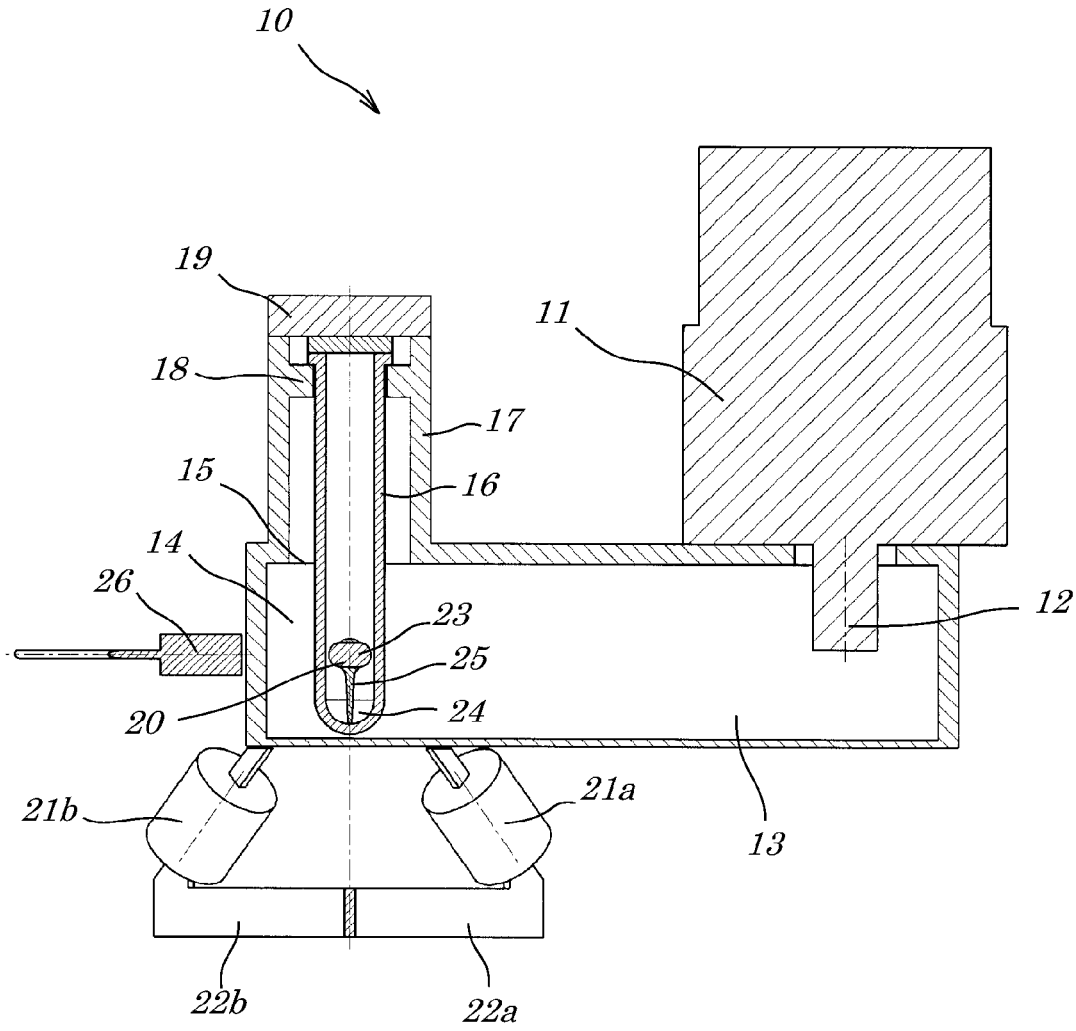
FIG. 2 is a schematic cross-section of the embodiment of FIG. 1.

Making reference to FIGS. 1 and 2, a device for uniformly heating a sample by microwave radiation in accordance with a first embodiment of the present invention, is shown in perspective and cross-sectional view, respectively. The device 10 comprises a microwave generator 11 having an antenna 12 which extends into a longitudinal wave guide 13. A terminal portion 14 of the wave guide 13 defines a cavity having an upper opening 15, through which a vessel 16 housing a sample to be treated by microwave radiation can be inserted into the cavity. The opening 15 is surrounded by a cylindrical tubular section 17 extending upwardly from the opening 15. The inner diameter of the opening 15 which corresponds to the inner diameter of the tubular section 17 as well as the height of the tubular section 17 are selected as a function of the frequency of the microwave radiation such that propagation of microwave radiation out of the cavity portion 14 of the wave guide 13 is effectively prevented. Similar microwave heating devices are for instance described in more detail in U.S. Pat. No. 4,681,740. In the embodiment shown in FIGS. 1 and 2, the tubular section 17 has an inwardly projecting peripheral shoulder 18, on which a corresponding shoulder of vessel 16 can rest in order to suspend vessel 16 in a suitable height such that the sample arranged in vessel 16 is located within cavity 14. The tubular section 17 can be closed by a lid 19 thus allowing microwave heating under pressure.

As can be seen in the cross-sectional view of FIG. 2, a stirring element 20 is immersed in sample vessel 16. Electric coils are arranged outside of the microwave cavity 14 in a manner such that an alternating magnetic field is produced in the area of stirring element 20. At least two sequentially operated coils are necessary in order to impart a rotational movement to the stirring element 20. In the embodiment shown in FIGS. 1 and 2, four coils 21*a*, 21*b*, 21*c* and 21*d* (with coil 21*d* being invisible in the drawings) are arranged in a cross-like pattern defined by metallic yokes 22*a*, 22*b*, 22*c*, 22*d*, respectively. Two opposing coils (e.g. 21*a* and 21*b* in FIG. 2) are connected with each other and the propagating magnetic field is generated by applying an alternated current to the coil pairs. For instance, one coil pair can be driven by a sinus wave current and the other pair by a co-sinus wave, i.e. an alternating current phase-shifted by 90° with respect to the alternating current driving the other coil pair. The actuator system described in the embodiment of FIGS. 1 and 2 does not require any moving motorized parts. In a variant of the embodiment of FIGS. 1 and 2, however, permanent magnets may be used which are rotated by a suitable motor. Both variants allow, however, controlling the rotational speed of the stirring element either by controlling the frequency of the alternating current fed through the coils or by controlling the rotational speed of motorized permanent magnets acting as actuators.

The stirring element 20 is made from a magnetic or magnetisable material and will couple to the magnetic field and start rotating with the frequency of the alternating magnetic field. In addition, by adjusting the strength of the magnetic field generated by the coils, the torque acting on the stirring element 20 can be adjusted.

As can be taken from FIG. 2, the stirring element can have an overall shape which ensures that the agitating upper part 23 of the stirring element 20 is suspended above any sediment or powder material 24 which may be present at the bottom of sample vessel 16. To this effect, the stirring element 20 depicted in FIG. 2 is provided with a longitudinal central shaft 25 extending downward from the agitator part 23.

In the embodiment of FIGS. 1 and 2, a Hall sensor 26 is arranged outside the microwave cavity 14. The Hall sensor 26 is adapted to sense changes in the magnetic field induced by the rotating stirring element 20. The arrangement of Hall sensor 26 outside of cavity 16 ensures that the Hall sensor 26 is shielded from the microwave radiation propagating inside the wave guide 13 and cavity 14. As a matter of fact, the magnetic field detected by the Hall sensor 26, is effectively a superposition of the alternating magnetic field generated by coils 21 and the alternating field generated by the stirring element 20. Changing magnetic fields result in changing output voltages of Hall sensor 26. In order to discriminate between magnetic field components resulting from the actuator system (either electric coils as depicted in FIGS. 1 and 2 or an actuator system based on permanent magnets), a phase-sensitive detection of the output voltage of Hall sensor 26 is preferably used. To this effect, the output voltage of Hall sensor 26 is fed to a lock-in amplifier (not depicted in the drawings). In the lock-in amplifier, a voltage signal of the Hall sensor and a second input signal, which is preferably a multiple of the frequency of the actuator system, are multiplied with each other and subsequently integrated by a low pass filter such that the output signal is effectively a cross correlation between the Hall sensor signal and the reference signal, i.e. a multiple of the actuator frequency. A cross correlation of signals comprising different frequency yields no output signal while similar signals yield a measurable output signal. Consequently, by suitably tailoring the frequency of the reference signal, the respective frequency component in the measured signal can be amplified. In a preferred embodiment, the third harmonic of the frequency of the actuator system is used to amplify the corresponding frequency signal measured by the Hall sensor. It was found that the output of the lock-in system can be used to determine whether the stirring element 20 is rotating with the desired frequency or not. Consequently, the operation of the microwave generator can be controlled via the output signal of the lock-in amplifier.

Figure 3:
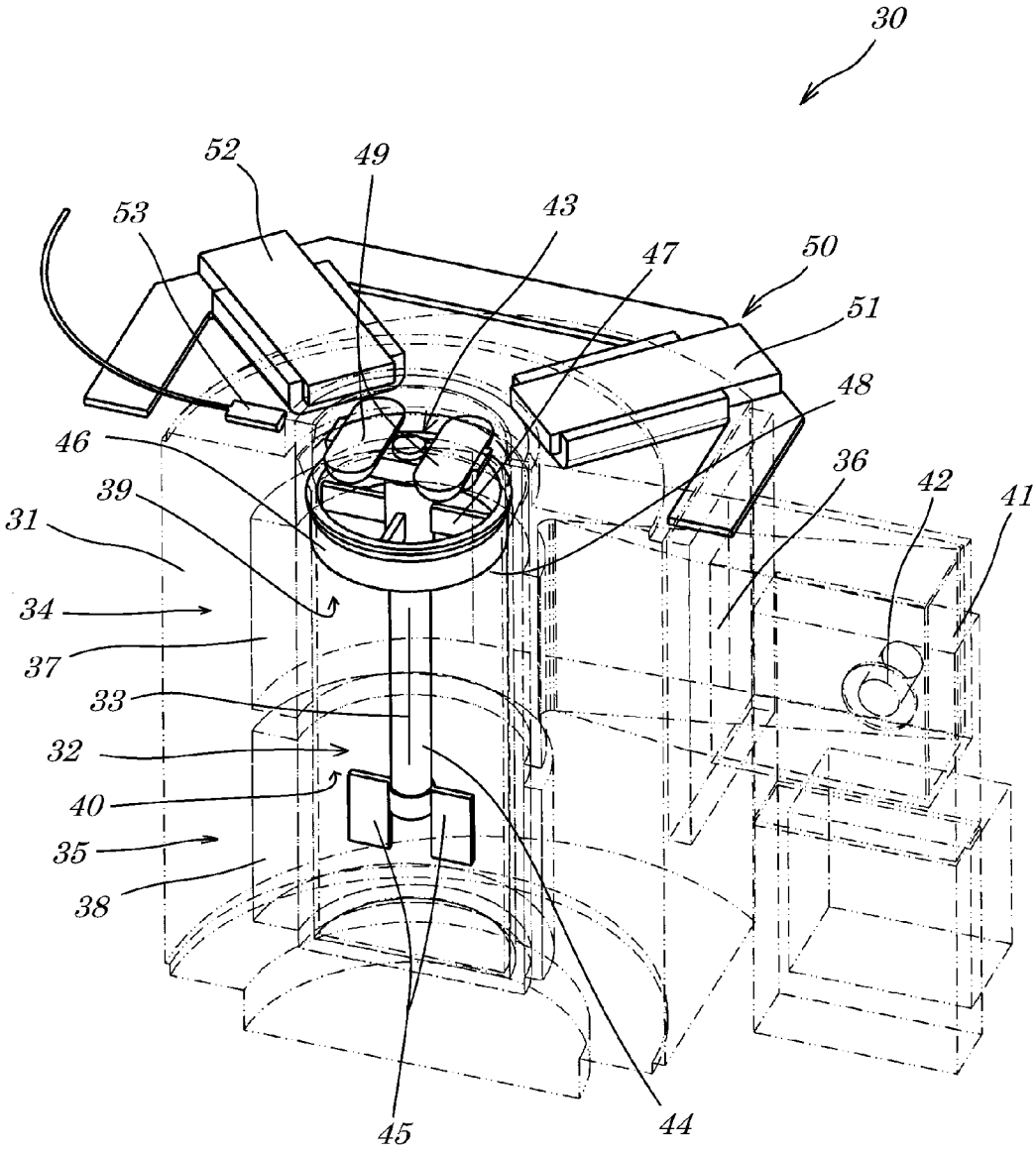
FIG. 3 is a partly perspective, partly cross-sectional view of a device for uniformly heating a sample by microwave radiation.

While the device described in FIGS. 1 and 2 is particularly suited for mono-mode cavities and consequently rather small sample volumes, the embodiment depicted in FIG. 3 can be used to heat larger samples as well.

In FIG. 3, a modular microwave applicator is used which is described in more detail in applicant's European Patent Application EP 08 150 982.0. In the embodiment of the present invention, the microwave applicator is equipped with a contactlessly driven overhead stirrer and a contactlessly operating Hall sensor for detecting rotational movement of the stirrer.

As shown in FIG. 3 in a partly cross-sectional view, the microwave-heating apparatus 30 comprises a housing 31 in which an essentially cylindrical sample cavity 32 having a longitudinal axis 33 is arranged. The cylindrical cavity 32 is defined by two similar microwave applicator modules 34, 35 stacked upon each other in the longitudinal direction of the central longitudinal axis 33 of the cavity in order to provide a larger overall interface for transmitting microwave radiation into the sample. Each applicator module 34, 35 has a microwave transmission duct comprising a rectangular waveguide portion 36 with constant internal dimensions and a tapering waveguide portion 37, 38 (the waveguide portion with constant dimensions of the lower applicator module 35 is not shown in the drawing). The tapering portions 37, 38 of the applicator module 34, 35 are arranged such that the direction of propagation of the microwave radiation is essentially perpendicular to the longitudinal axis 33 of the sample cavity 32. The external walls of rectangular and tapering waveguide portions 36 and 37, 38 are made from conductive metal sheets and define the microwave applicator. In a inner segment of the wall defining the tapering portions 37, 38 of the transmission ducts, interfaces 39, 40 made from a material which is partially permeable to microwave radiation are provided. Although the general direction of propagation of the microwave radiation inside the applicator is essentially parallel to the interfaces 39, 40, a part of the microwave radiation will be transmitted perpendicularly to the overall direction of propagation through the interface into the sample cavity 32. The interfaces 39, 40 may comprise several layers of varying dielectric constant. Upon absorption of the transmitted microwave radiation, sample arranged in cavity 32 is heated. Due to the tapering of the transmission ducts, the energy density transmitted into the sample per unit area of the interfaces 39, 40 will be essentially constant along the direction of propagation. As shown for the upper applicator module 34, the source of microwave energy comprises a first magnetron 41 arranged outside of the first rectangular waveguide portion 36. An antenna 42 coupled to the magnetron is inserted into the first rectangular waveguide portion 36 in order to generate microwave radiation which is transmitted towards a tapering waveguide portion 37 of the first applicator module 34. A similar arrangement of a second magnetron (not shown in FIG. 3) and a second rectangular waveguide portion (not shown in FIG. 3) is provided for the lower second applicator module 35. The rectangular and tapering portions of the microwave transmission ducts can be filled with any dielectric material having a low absorbance for microwave radiation, e.g. a solid dielectric material such as PTFE.

In order to ensure reliable stirring of the sample in the sample cavity 32, a magnetically driven overhead stirrer 43 is arranged in the sample cavity 32. The overhead stirrer 43 comprises a vertically arranged shaft 44 having a longitudinal central axis which coincides with the longitudinal central axis 33 of the cylindrical sample cavity 32. In the lower end of shaft 44, stirrer paddles 45 are arranged. The upper end of shaft 44 rests rotatably on a recessed circumferential inner shoulder 48 provided in the upper part of sample cavity 32. E.g. in the depicted embodiment a guide ring 46 is fixed in the circumferential inner shoulder 48 for guiding spokes 47 which are fixed to the upper end of the shaft 44 and which extend between the shaft and the guide ring. The addition magnetic elements 49 are fixed to the upper end of shaft 44. The magnetic elements 49 can couple to a driving magnetic field generated by an external magnetic actuator 50 formed by several electronically controlled solenoids arranged circumferentially around the upper end of the sample cavity 32 (two solenoids 51, 52 of the driving solenoid system 50 are depicted in FIG. 3).

In order to reliably monitor and/or control the rotation of overhead stirrer 43, a Hall sensor 53 is arranged outside of the sample cavity 32 in a height corresponding to the location of the magnetic elements 49, 50 so that variations of the magnetic field caused by the rotating magnetic elements 49, 50 can be sensed and used to control the output power of the magnetrons of the upper and lower microwave applicator modules 34, 35, respectively.

Due to its modular design, the microwave heating apparatus 30 can readily be adapted to specific requirements. For instance, the overhead stirrer 43 can be substituted by others similar stirrers having specific agitators adapted to sample to be mixed, such as disc turbines, radial impellers, cross blades, gate paddles, flat blade paddles, anchors, axial or radial impellers, propellers, spirals, counter-current agitators, or combinations thereof. The stirrers can be single or multi-stage stirrer.

A lid (not shown in FIG. 3) is preferably provided to protect the sample from contamination and/or to ensure that pressurised heating is possible. In this case, the stirrer 43 can be completely arranged within the pressurized sample cavity so that no pressure-tight bearings for the driveshaft of the stirrer have to be provided. Again, even in a closed pressurized vessel, a stirrer such as overhead stirrer 43 can be contactlessly driven by an externally applied magnetic filed and the rotation of the stirrer can be contactlessly monitored by a suitable sensor such as Hall sensor 53.

Having described the invention, the following is claimed:

1. A method for uniformly heating a sample by microwave radiation comprising:

immersing at least one stirring element at least partly in a sample to be heated, said stirring element comprising a magnetic or magnetisable material;

generating a rotating or oscillating magnetic field interacting with said stirring element in order to impart a rotational or translational movement to said stirring element;

contactlessly detecting rotational or translational movement of said stirring element; and applying microwave radiation to said sample.

2. The method of claim 1, comprising generating said rotating or oscillating magnetic field by a moving magnetic actuator.

3. The method of claim 1, comprising generating said rotating or oscillating magnetic field by a stationary solenoid system.

4. The method of claim 1, comprising detecting said rotational or translation movement of said stirring element by measuring magnetic and/or electric effects caused by said magnetic or magnetized stirring element.

5. The method of claim 4, comprising measuring a changing magnetic field caused by said moving magnetic or magnetized stirring element.

6. The method of claim 5, comprising phase-sensitive detection of said changing magnetic field.

7. The method of claim 4, comprising measuring a back electromotive force (bemf) caused by said moving magnetic or magnetized stirring element.

8. The method of claim 1, wherein the detected movement of said stirring element is used to control said rotating or oscillating magnetic field interacting with said stirring element and/or to control said heating of said sample.

9. A device for uniformly heating a sample by microwave radiation comprising:

a cavity adapted to receive a sample to be heated;

a source of microwave radiation adapted to generate a microwave field in said cavity;

at least one stirring element adapted to be at least partly immersed in said sample, said stirring element comprising a magnetic or magnetisable material;

means for generating a rotating or oscillating magnetic field interacting with said stirring element in order to impart a rotational or translational movement to said stirring element; and means for detecting rotational or translational movement of said stirring element.

10. The device of claim 9, wherein said means for generating a rotating or oscillating magnetic field comprise a movable magnetic actuator or a stationary solenoid system.

11. The device of claim 9, wherein said means for detecting rotational or translation movement of said stirring element comprise means for measuring changing magnetic fields.

12. The device of claim 11, wherein said means for measuring changing magnetic fields comprise a Hall detector or a magneto-optic Kerr cell.

13. The device of claim 11, wherein said means for measuring changing magnetic fields comprise means for measuring a back electromotive force induced in a coil.

14. The device of claim 13, wherein said coil is part of said means for generating a rotating or oscillating magnetic field or wherein said coil is a separate detection coil.

15. The device of claim 9, comprising means for evaluating the speed of said stirring element, said evaluating means being adapted to control at least one of said source of microwave radiation and said means for generating a rotating or oscillating magnetic field.

* * * * *